US010352098B2

(12) United States Patent
Frensley

(10) Patent No.: US 10,352,098 B2
(45) Date of Patent: Jul. 16, 2019

(54) STEP PLATFORM FOR STEPLADDER

(71) Applicant: Alan Charles Frensley, Anchorage, AK (US)

(72) Inventor: Alan Charles Frensley, Anchorage, AK (US)

( * ) Notice: Subject to any disclaimer, the term of this patent is extended or adjusted under 35 U.S.C. 154(b) by 0 days.

(21) Appl. No.: 15/815,597

(22) Filed: Nov. 16, 2017

(65) Prior Publication Data

US 2019/0145171 A1 May 16, 2019

(51) Int. Cl.
*E06C 7/16* (2006.01)

(52) U.S. Cl.
CPC ..... *E06C 7/165* (2013.01)

(58) Field of Classification Search
CPC ..... E06C 7/00; E06C 7/10; E06C 7/16; E06C 7/165; E06C 7/087; E06C 7/08; B21D 53/00; B21D 53/04; B21D 5/00; B21D 13/00; B21D 25/00; B21D 31/00
See application file for complete search history.

(56) References Cited

U.S. PATENT DOCUMENTS 2,174,891 A * 10/1939 Maran ..... E06C 7/16 182/121
2,415,327 A * 2/1947 Yothers ..... E06C 7/165 182/120
2,488,633 A * 11/1949 Linder ..... E06C 7/165 182/120
2,805,104 A * 9/1957 Johnson ..... E06C 7/165 182/120
3,294,197 A * 12/1966 Kwiatkowski ..... E06C 7/16 182/120
4,804,063 A * 2/1989 Farris ..... E06C 7/08 182/121
5,005,668 A * 4/1991 Nowlan ..... E06C 7/16 182/121
5,052,515 A * 10/1991 Nowlan ..... E06C 7/16 182/121
5,056,620 A * 10/1991 Zumwalt ..... E06C 7/165 182/120
6,786,300 B1 * 9/2004 Bonifacini ..... E06C 7/165 182/120
6,994,185 B1 * 2/2006 Hertel ..... E06C 7/00 182/129
8,727,074 B1 * 5/2014 Bhajan ..... E06C 7/165 182/119

(Continued)

OTHER PUBLICATIONS

IDS Transmittal Letter submitted herewith disclosing a "Safe Step" product that was demonstrated in a video published on YouTube in 2012.

*Primary Examiner* — Katherine W Mitchell
*Assistant Examiner* — Shiref M Mekhaeil
(74) *Attorney, Agent, or Firm* — Davis Wright Tremaine LLP; Heather M. Colburn

(57) ABSTRACT

A step platform for use with a stepladder having front and back legs. The front leg has a plurality of steps. The step platform includes a tread portion connected to a locking portion. The tread portion has a front portion configured to rest upon a selected one of the steps and a back portion configured to extend from the front portion toward the back leg beyond the selected step. The locking portion extends alongside a front portion of the selected step and at least partially wraps around a lower edge of the front portion.

12 Claims, 5 Drawing Sheets

(56) References Cited

U.S. PATENT DOCUMENTS

| | | | | |
|---|---|---|---|---|
| D728,128 | S * | 4/2015 | Haney | D25/68 |
| D791,972 | S * | 7/2017 | Goodnow | D25/68 |
| 9,777,535 | B1 * | 10/2017 | Stentiford, Sr. | E06C 7/08 |
| 2005/0037188 | A1 * | 2/2005 | Ehrstrom | B32B 15/08 428/299.4 |
| 2007/0240935 | A1 * | 10/2007 | O'Brien | E06C 7/165 182/120 |
| 2011/0297482 | A1 * | 12/2011 | O'Brien | E06C 7/165 182/129 |
| 2014/0326538 | A1 * | 11/2014 | Najey | E06C 7/08 182/129 |
| 2016/0177626 | A1 * | 6/2016 | Miller | E06C 7/14 396/419 |
| 2016/0186494 | A1 | 6/2016 | Matthew | |
| 2016/0348433 | A1 * | 12/2016 | Goodnow | E06C 7/16 |
| 2017/0167198 | A1 * | 6/2017 | Goodnow | E06C 7/08 |

* cited by examiner

STEP PLATFORM FOR STEPLADDER

BACKGROUND OF THE INVENTION

Field of the Invention

The present invention is directed generally to accessories for use with stepladders.

Description of the Related Art

Stepladders typically have narrow steps. When a user needs to stand on one of these narrow steps for an extended period of time, the user's weight is supported by only a portion of each of the user's feet. This can cause fatigue in the user's feet, knees, and/or back.

BRIEF DESCRIPTION OF THE SEVERAL VIEWS OF THE DRAWING(S)

Like reference numerals have been used in the figures to identify like components.

DETAILED DESCRIPTION OF THE INVENTION

Figure 1:
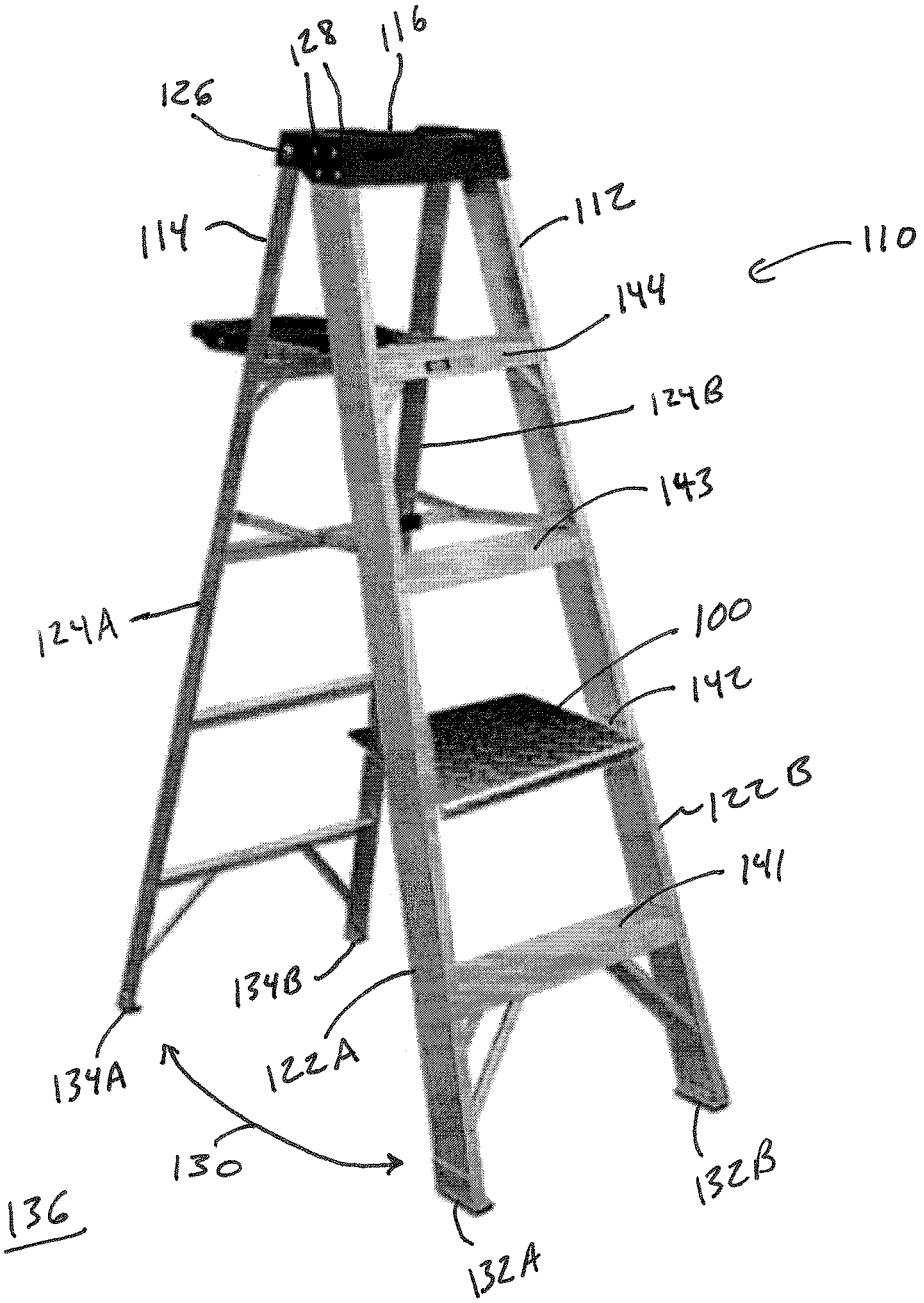
FIG. 1 is a perspective view of a step platform installed on a folding stepladder.

FIG. 1 illustrates a step platform 100 installed on a folding stepladder 110. By way of non-limiting examples, the stepladder 110 may be constructed from aluminum and/or fiberglass. The stepladder 110 may be characterized as having an A-frame shape defined by a front leg 112 coupled to a rear leg 114 by a top cap 116. The front leg 112 includes first and second spaced apart front rails 122A and 122B and the rear leg 114 includes first and second spaced apart rear rails 124A and 124B. In the embodiment illustrated, the first and second rear rails 124A and 124B are each coupled to the top cap 116 by a hinge or pivot pin 126. The pivot pin 126 may be implemented as a single pivot pin that couples both the first and second rear rails 124A and 124B to the top cap 116 or as separate pivot pins that separately couple the first and second rear rails 124A and 124B to the top cap 116. In the embodiment illustrated, the first and second front rails 122A and 122B are coupled to the top cap 116 by one or more fasteners 128. The first and second rear rails 124A and 124B are rotatable about the pivot pin(s) 126 with respect to the front leg 112 in directions indicated by double-headed arrow 130.

The first and second front rails 122A and 122B have front feet 132A and 132B, respectively, configured to rest on a support surface 136 (e.g., the ground). Similarly, the first and second rear rails 124A and 124B have rear feet 134A and 134B, respectively, configured to rest on the support surface 136. The front feet 132A and 132B are not connected to the rear feet 134A and 134B. As shown in FIG. 1, the stepladder 110 is free standing on the front and rear feet 132A, 132B, 134A, and 134B when the front feet 132A and 132B are adequately spaced apart from the rear feet 134A and 134B, respectively. The front feet 132A and 132B may be adequately spaced apart from the rear feet 134A and 134B, respectively, by rotating the rear leg 114 away from the front leg 112 about the pivot pin(s) 126.

Figure 2:
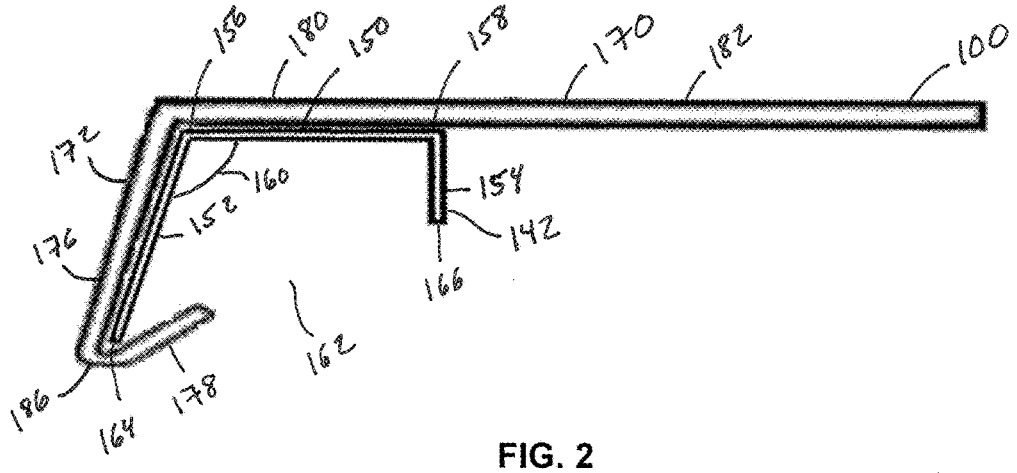
FIG. 2 is a cross-sectional view of a step of the stepladder with the step platform installed thereupon.

A plurality of flat rungs or steps 141-144 extend between the first and second front rails 122A and 122B. The steps 141-144 are positioned along the first and second front rails 122A and 122B between the top cap 116 and the front feet 132A and 132B. The steps 141-144 are substantially identical to one another. Therefore, for the sake of brevity, only the step 142 will be described in detail. Referring to FIG. 2, each of the steps 141-144 (see FIG. 1) may have a top or tread portion 150, a front portion 152, and a back portion 154. The tread portion 150 is configured to be stood upon by a user 155 (see FIG. 8). The front portion 152 is connected to a front end 156 of the tread portion 150 and extends downwardly from the front end 156. Similarly, the back portion 154 is connected to a rear end 158 of the tread portion 150 and extends downwardly from the rear end 158. As shown in FIG. 2, an inside angle 160 of about 110 degrees may be defined between the front portion 152 and the tread portion 150. An opening 162 is defined between a free lower edge 164 of the front portion 152 and a free lower edge 166 of the back portion 154.

Figure 5:
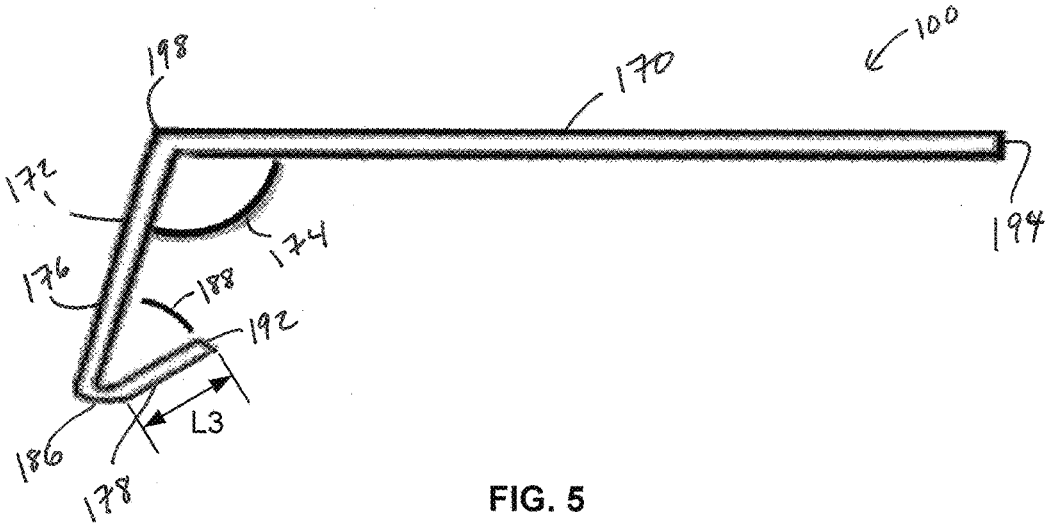
FIG. 5 is a side view of the step platform.

Referring to FIG. 5, the step platform 100 has a step or tread portion 170 connected to a locking portion 172. The tread portion 170 is configured to be stood upon by the user 155 (see FIG. 8). In the embodiment illustrated, an inside angle 174 of about 110 degrees is defined between the tread portion 170 and the locking portion 172. The locking portion 172 includes first and second members 176 and 178.

Figure 3:
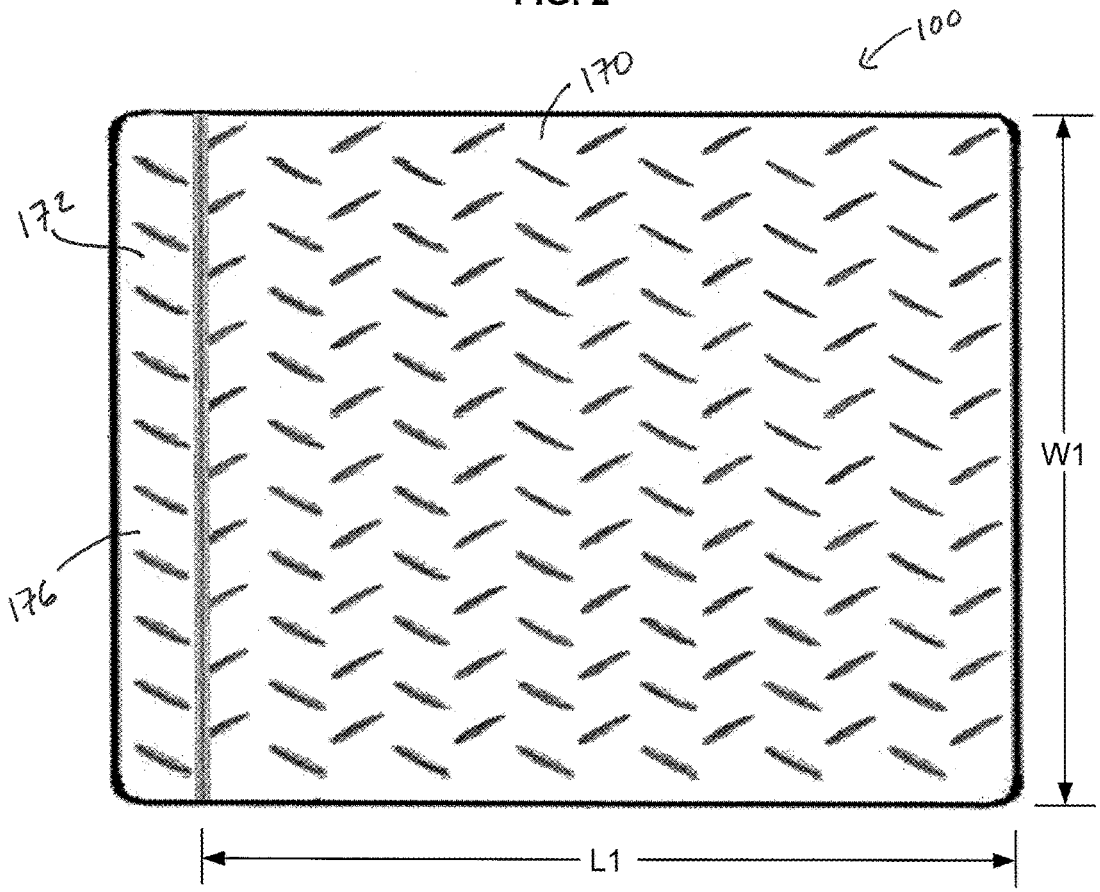
FIG. 3 is a top view of the step platform.

While the step platform 100 may be installed on any of the steps 141-144 (see FIG. 1), FIG. 2 illustrates the step platform 100 installed on the step 142. Therefore, the step platform 100 will be described as being installed on the step 142. As shown in FIG. 2, a front portion 180 of the tread portion 170 rests upon the tread portion 150 of the step 142 and a rear portion 182 extends backwardly toward the rear leg 114 (see FIG. 1) beyond the tread portion 150 of the step 142. Thus, the tread portion 170 of the step platform 100 provides a larger surface for the user 155 (see FIG. 8) to stand upon than the step 142. By way of a non-limiting example, referring to FIG. 3, the tread portion 170 may have a width "W1" of about 11.5 inches and a length "L1" of about 12 inches.

Figure 4:
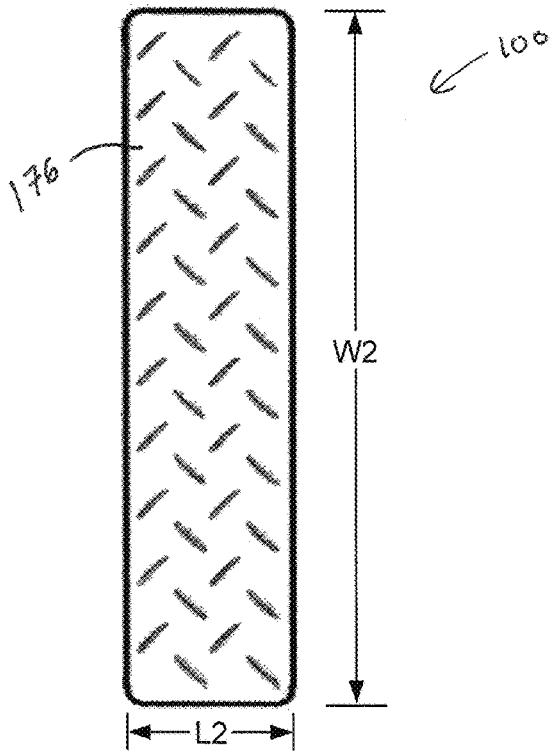
FIG. 4 is a front view of a first member of the step platform.

Referring to FIG. 5, the locking portion 172 is configured to be removably attached to one of the steps 141-144 (see FIG. 1). The front facing first member 176 is connected to the second member 178 by a bent portion 186. By way of a non-limiting example, the bent portion 186 may have an inside angle 188 of about 40 degrees. Referring to FIG. 4, by way of a non-limiting example, the first member 176 may have a width "W2" and a length "L2." The width "W2" may be equal to the width "W1" and the length "L2" may be about 1.5 inches. Referring to FIG. 5, by way of another non-limiting example, the second member 178 may have a width (not shown) equal to the width "W1" and a length "L3" of about 1.25 inches.

Referring to FIG. 2, the locking portion 172 secures the step platform 100 to one of the steps 141-144 (see FIG. 1) of the stepladder 110 (see FIG. 1). When attached to one of the steps 141-144 (see FIG. 1), the first member 176 is positioned alongside the front portion 152 of the step 142.

The bent portion 186 wraps partway around the lower edge 164 of the front portion 152 to position at least a portion of the second member 178 behind the front portion 152. Thus, the second member 178 is hooked onto the lower edge 164 such that when the user 155 (see FIG. 8) steps on the rear portion 182 of the tread portion 170, the second member 178 prevents the step platform 100 from disengaging from the step 142. Referring to FIG. 1, the user 155 (see FIG. 8) may safely ascend the stepladder 110 when the step platform 100 is coupled to one of the steps 141-144 (see FIG. 1).

As mentioned above, for ease of illustration, the locking portion 172 will be described as being coupled to the step 142. Referring to FIG. 2, the locking portion 172 is secured to the step 142 by inserting the lower edge 164 of the front portion 152 of the step 142 into the bent portion 186. Then, the step platform 100 is rotated toward the step 142 thereby inserting the tread portion 170 between the first and second front rails 122A and 122B (see FIG. 1) above the step 142. The step platform 100 is rotated until the first member 176 is alongside the front portion 152 and the front portion 180 of the tread portion 170 rests on the step 142.

Figure 6:
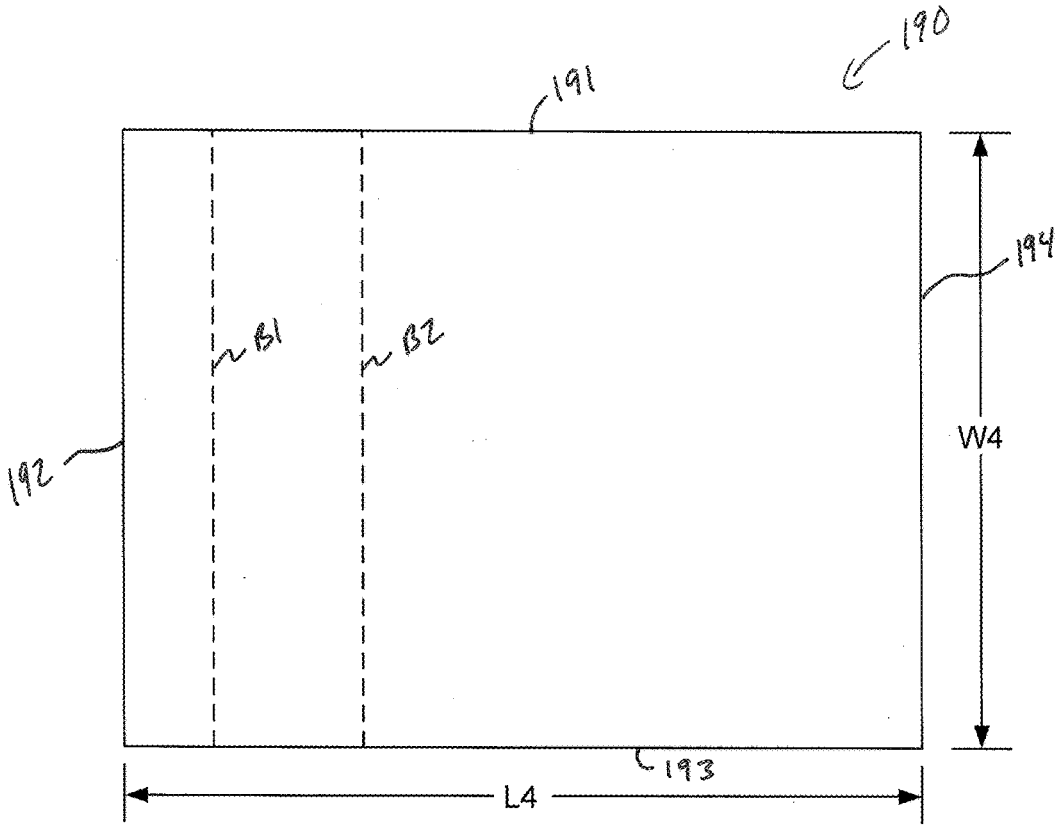
FIG. 6 is a top view of a plate used to construct the step platform.

The step platform 100 may be constructed from a single plate 190 (see FIGS. 6 and 7) of material. Referring to FIG. 6, by way of a non-limiting example, the plate 190 may be constructed from 5086 non-heat-treated aluminum (an alloy consisting of aluminum and magnesium) having a density of at least 2,660 kg/m$^3$. Optionally, the plate 190 may be a diamond plate, a checker plate, a tread plate, or a Durbar floor plate. The step platform 100 (see FIGS. 1-5) may be formed by bending the plate 190 at locations identified by dashed lines "B1" and "B2" to create first and second bends 196 (see FIG. 7) and 198 (see FIG. 5), respectively.

The plate 190 has outer edges 191-194. The outer edge 192 is opposite the outer edge 194 and the outer edge 191 is opposite the outer edge 193. The outer edges 192 and 194 are substantially orthogonal to the outer edges 191 and 193. In the example illustrated in FIG. 6, the plate 190 has a width "W4" (e.g., about 11.5 inches) from the outer edge 191 to the outer edge 193. The width "W4" may be equal to the width "W1." The plate 190 has a length "L4" (e.g., about 15 inches) from the outer edge 192 to the outer edge 194. The length "L4" is greater than a sum of the lengths "L1," "L2," and "L3" (e.g., about 14.75 inches) to allow for the first and second bends 196 and 198.

Figure 7:
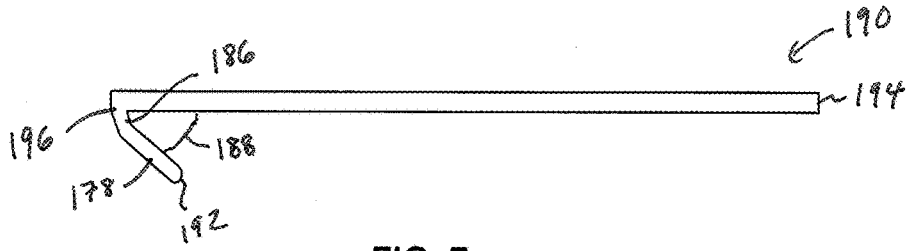
FIG. 7 is a side view of the plate after a first bend has been formed therein.

Referring to FIG. 7, the first bend 196 (e.g., about 40 degrees) creates the bent portion 186 and is formed at a distance equal to the length "L3" (see FIG. 5) from the outer edge 192 of the plate 190. The second member 178 is defined between the bent portion 186 and the outer edge 192 of the plate 190. Thus, the outer edge 192 is also a free edge of the second member 178. Next, referring to FIG. 5, the second bend 198 is formed by bending (e.g., about 110 degrees) the plate 190 (see FIGS. 6 and 7) at a distance equal to the length "L2" (see FIG. 4) from the bent portion 186. The first member 176 is defined between the second bend 198 and the bent portion 186.

The step platform 100 allows the user 155 (see FIG. 8) to stand for long periods of time on the step platform 100 with reduced fatigue to feet, knees, and/or back. The step platform 100 has been tested by a user of 280 pounds Avoirdupois and successfully supported the user.

Figure 8:
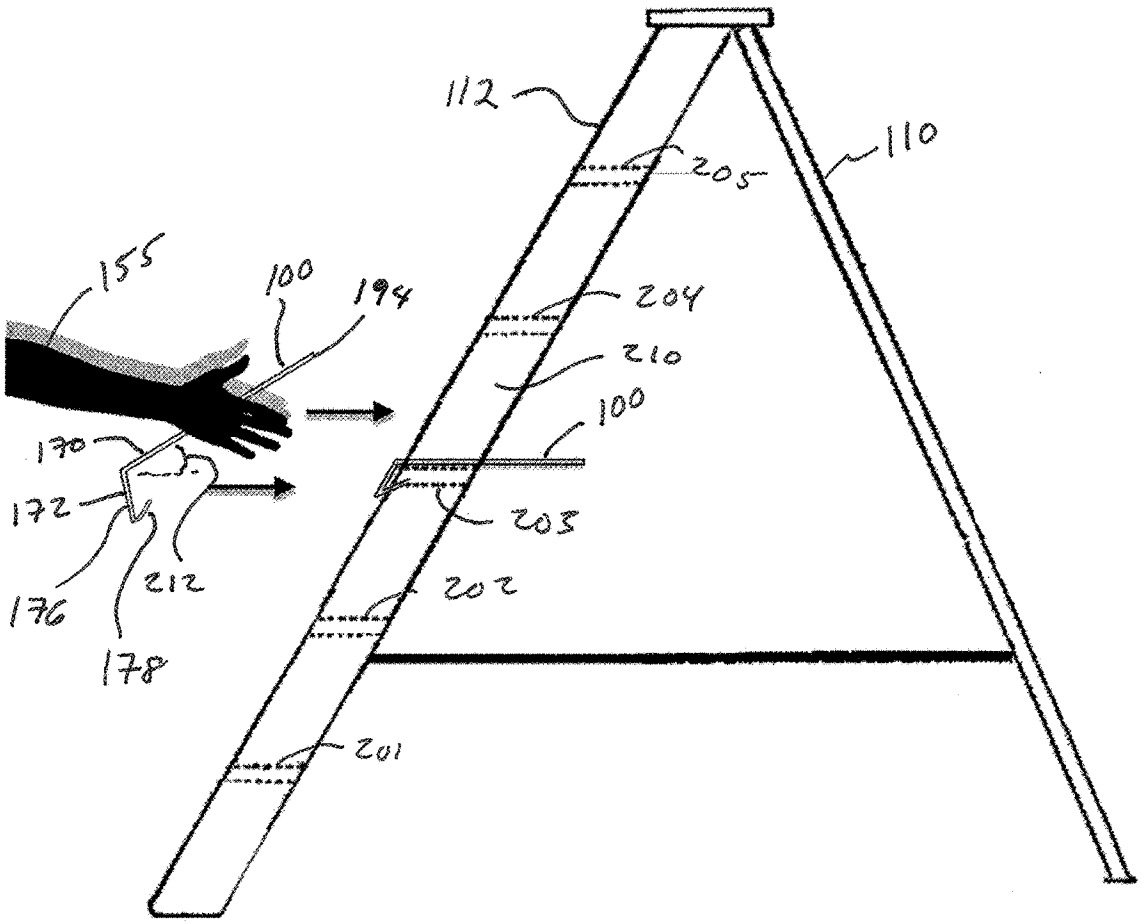
FIG. 8 is a side view of the plate being attached to a single step.

The following is a description of a method that may be used to install the step platform 100 on the stepladder 110 and use the step platform 100 safely after it has been installed on the stepladder 110. Referring to FIG. 8, in this example, the stepladder 110 has five steps 201-205. The method begins with the user 155 approaching the front leg 112 of the stepladder 110 and holding the step platform 100 with a top surface of the tread portion 170 facing upwardly and the locking portion 172 positioned closest to the user 155. Then, the outer edge 194 is inserted into a space 210 between a selected one of the steps 201-205 and a next step immediately above the selected step. For ease of illustration, the selected step will be described as being the step 203. The user 155 inserts the tread portion 170 into the space 210 at an insertion angle 212 (e.g., about 45°) until the first member 176 is touching the step 203 and the second member 178 is immediately underneath the front portion 152 (see FIG. 2) of the step 203. Additionally, referring to FIG. 2, the first member 176 should be in contact with lower edge 164 of the front portion 152. Then, the user 155 lowers the outer edge 194 until the underside of the front portion 180 (see FIG. 2) of the tread portion 170 is resting on the tread portion 150 (see FIG. 2) of the step 203. At this point, it is safe for the user 155 to climb the stepladder 110 up to the step 203 with the step platform 100 installed thereon. The step platform 100 may be used in this manner to support a maximum weight (e.g., up to 280 pounds Avoirdupois).

The step platform 100 may be used with a variety of stepladders. However, the dimensions provided may not work with steps wider than 16.5 inches because such steps may be compromised if the maximum weight is applied thereto. It may not be safe to install the step platform 100 on any step that is broken, damaged, and/or otherwise not in a safe and sound condition. It may not be safe to use the step platform 100 if the step platform 100 is not secured on the step. Additionally, it is advisable that the user 155 observe safety rules when using any equipment including, but not limited to, wearing appropriate footwear.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A method of constructing a step platform, the method consisting of: obtaining a rectangular plate bounded by first, second, third, and fourth outer edges, the first outer edge being opposite the third outer edge, the second outer edge being opposite the fourth outer edge, the second and fourth outer edges being substantially orthogonal to the first and third outer edges; forming a first bend in the plate at a first predetermined distance from the second outer edge of the plate, a second member being defined between the first bend and the second outer edge; and forming a second bend in the plate at a second predetermined distance from the first bend, a first member being defined between the first and second bends, a tread portion of the plate being defined between the second bend and the fourth outer edge, the tread portion of the plate being unbent, the tread portion of the plate extending from the first outer edge to the third outer edge and extending from the second bend to the fourth outer edge, the tread portion of the plate comprising a front portion connected to the first member and configured to rest upon a step of a stepladder, the tread portion of the plate comprising a back portion that extends backwardly, from the front portion of the tread portion of the plate, beyond the step, the first member being configured to extend alongside a front portion of the step, the first bend being configured to wrap at least partially around a lower edge of the front portion of the step to position at least a portion of the second member behind the front portion of the step.

2. The method of claim 1, wherein the second bend has a first inside angle of 110 degrees.

3. The method of claim 1, wherein the first bend has a second inside angle of 40 degrees.

4. The method of claim 1, wherein the first bend has an inside angle of 40 degrees.

5. The method of claim 1, wherein the rectangular plate is a diamond plate, a checker plate, or a tread plate.

6. The method of claim 1, wherein the rectangular plate is constructed from 5086 non-heat-treated aluminum having a density of at least 2,660 kg/m3.

7. The method of claim 1, wherein the rectangular plate has a length from the second outer edge to the fourth outer edge of 15 inches.

8. The method of claim 1, wherein the rectangular plate has a width from the first outer edge to the third outer edge of 11.5 inches.

9. The method of claim 1, wherein the second member has a second length from the first bend to the second outer edge of 1.25 inches.

10. The method of claim 9, wherein the first member has a first length from the first bend to the second bend of 1.5 inches.

11. The method of claim 1, wherein the first member has a length from the first bend to the second bend of 1.5 inches.

12. The method of claim 1, wherein the tread portion has a length from the second bend to the fourth outer edge of 12 inches.

* * * * *